US008727849B2

(12) United States Patent
Kevan

(10) Patent No.: US 8,727,849 B2
(45) Date of Patent: May 20, 2014

(54) BOARD GAMES AND METHODS OF PLAYING

(71) Applicant: Enviroquest, Ltd., Cambridge (CA)

(72) Inventor: Sherrene D. Kevan, Cambridge (CA)

(73) Assignee: Enviroquest Ltd., Cambridge (CA)

( * ) Notice: Subject to any disclaimer, the term of this patent is extended or adjusted under 35 U.S.C. 154(b) by 14 days.

(21) Appl. No.: 13/647,432

(22) Filed: Oct. 9, 2012

(65) Prior Publication Data

US 2013/0035145 A1 Feb. 7, 2013

Related U.S. Application Data

(63) Continuation-in-part of application No. 12/888,953, filed on Sep. 23, 2010, now abandoned.

(60) Provisional application No. 61/244,904, filed on Sep. 23, 2009.

(51) Int. Cl.
*A63F 3/00* (2006.01)
*A63F 13/00* (2006.01)

(52) U.S. Cl.
USPC ..... 463/10; 273/243; 273/251; 273/257; 273/278; 463/11

(58) Field of Classification Search
USPC ..... 273/243, 251, 257, 278; 463/10–11
See application file for complete search history.

(56) References Cited

U.S. PATENT DOCUMENTS

| | | | | |
|---|---|---|---|---|
| 4,012,045 | A * | 3/1977 | Vail | 273/257 |
| 4,378,941 | A | 4/1983 | Derby | |
| 4,878,675 | A * | 11/1989 | Perry et al. | 273/251 |
| 6,322,076 | B1 * | 11/2001 | Fikki | 273/278 |
| 6,443,453 | B1 * | 9/2002 | Wallice | 273/243 |
| 7,597,326 | B2 * | 10/2009 | D'Antonio | 273/243 |
| 2006/0267278 | A1 * | 11/2006 | Belanger | 273/243 |
| 2008/0272543 | A1 * | 11/2008 | Martineau | 273/243 |

* cited by examiner

*Primary Examiner* — Dmitry Suhol
*Assistant Examiner* — Jason Yen
(74) *Attorney, Agent, or Firm* — Dinsmore & Shohl LLP

(57) ABSTRACT

A board game includes a plurality of game pieces, a plurality of reward cards, and a game board, where the game board includes a travel path on the game board, said travel path including a plurality of instruction spaces, a plurality of hidden cache spaces, and a plurality of open cache spaces, where one of said plurality of hidden cache spaces and one of said plurality of open cache spaces are associated with one of said plurality of game pieces, and at least one instruction space includes directions to add one of said plurality of reward cards to one of said plurality of open cache spaces that is associated with one of said plurality of game pieces.

20 Claims, 14 Drawing Sheets

402

400

An ornithologist (biologist that works with birds) climbs up the tree to band the young ravens in the next. You are busy dropping stones on top of the scientist's head. The raven player on your right steals a food piece from your open cache.

You are a playful raven. Lying on your back you miss the opportunity to take food to the hidden cache. You must wait one turn before you jump back on your feet.

402

400

You are a skilful raven. Using a branch as a tool, you collect one piece of food from the other 3 ravens. You may choose to put the 3 food pieces in the open or hidden cache.

You are a very hungry raven. You lead the other 3 ravens to a pack of wolves who are busy feeding on a dead deer carcass. For your good dead, you are awarded one piece of food.

402

400

Green raven loses a piece of food. This can be taken from the open cache. If none are there, the raven must give up one of the food pieces from its hidden cache. Food piece goes back into the centre (bowl).

Purple raven loses one piece of food. This can be taken from the open cache. If none are there, the raven must give up one of the food pieces from its hidden cache. Food pieces goes back into the centre (bowl).

Brown raven loses a piece of food. This can be taken from the open cache. If none are there, the raven must give up one of the food pieces from its hidden cache. Food piece goes back into the centre (bowl).

Blue raven loses a piece of food. This can be taken from the open cache. If none are there, the raven must give up one of the food pieces from its hidden cache. Food piece goes back into the centre (bowl).

Blue raven gains one piece of food. Take one piece of food from the centre (bowl).

Brown raven gains one piece of food. Take one piece of food from the centre (bowl).

FIG. 4A 402 400

| | |
|---|---|
| Green raven gains one piece of food. Take one piece of food from the centre (bowl). | Purple raven gains one piece of food. Take one piece of food from the centre (bowl). |

402 400

| | |
|---|---|
| You are a generous raven. Take one piece from your open cache and give it to the raven on the right. | You are a lucky raven. You came across another raven's hidden cache. Take a food piece from any raven's (player's) hidden food cache. Your choice! |

402 400

| | |
|---|---|
| Whoops! You got too close to the enemy, the owl. You lose a turn so that you can make a hasty retreat! | Whoops! You got too close to the enemy, the falcon. You lose a turn so that you can make a hasty retreat! |

| | |
|---|---|
| Go back 2 spaces. | Go back one space. |

| | |
|---|---|
| Go back 3 spaces. | Go forward one space. |

FIG. 4B 500 400

What is the common Latin name for the common raven?

Corvus coarax

What animal is commonly associated with ravens in story telling?

Coyote 500 400

What are the names of Odin's Ravens (European Mythology)?

Huginn and Muninn

In many cultures, the raven was another colour. What was the colour?

White 500 400

The Common Raven is also known as what?

Northern Raven

What family is the Raven found in?

Crow family or Corvidae 500 400

There are 8 subspecies of Ravens. Can you give the name of one of them?

C.c. subcorax; C.c. Varius; C.c. tibetanus; C.c. tingitanaus; C.c. sinuatus; C.c. principalis; C.c. kamtschaticus The Common Raven was described and identified by what scientist of the 18th century?

C. Linnaeus

The collective noun to describe a group of ravens is what?

"unkindness" or "conspiracy"

There are 3 ravens that are known to be close in relative of the Common Raven. What is the name of one of those ravens?

Chihuahua Raven (C. Cryptoleucus); Brown-necked Raven (C. ruficollis); Pied Crow (C. albus)

FIG. 5A 500 400

There are 2 clades that Ravens are grouped in. What are they?

California clade; Holarctic clade. Both look similar, but are found to be genetically different after testing their DNA.

What food source is known to increase nesting success (raising young) for ravens? Fast-food and other human garbage, or plants and invertebrates, or road-kill?

Fast-food,human garbage 500 400

Do ravens mate for life? Yes or No.

Yes

What materials make up a Raven's nest?

Twigs, mud, lining from animal fur, roots from plants 500 400

How long is the incubation period for the Common Raven eggs?

From 18 to 20 days is common

How long do the young, once they leave the nest, stay with their parents?

Usually it is around 6 months 500 400

What time of year (month) does the Common Raven lay eggs in the nest?

Around late February to early April depending on location

The Haida culture viewed the raven as a trickster and a _____?

God

What part of the bible talks (New or Old Testament) about ravens?

Old Testament

The poem "The Raven" was written by what author?

Edgar Allen Poe

FIG. 5B 500 400

Ravens is an American football team of what city?

Baltimore

What does ASCAR stand for?

American Society of Crows and Ravens 500 400

Ravens in Winter" was written by a scientist who studies ravens. Who is the scientist?

Dr. Bernd Heinrich

Is the crow bigger or smaller than the raven?

Bigger in length and body size 500 400

Are ravens found in every country in the world? Yes or no?

Yes; They can live in the arctic and tundra regions, and in deserts, forests, and urban areas How many eggs can a raven lay in the nest?

Between 4 and 7

What colour are the raven's eggs?

Usually a green (dull) that has brown spots

Where does the raven usually nest (location)?

They nest on a cliff or high up in a conifer tree

Ravens glide in the air on currents. What type of aerial displays are they known for? (just give one example).

Tumbling; play fighting

What other birds (common name) does the raven compete with for food around garbage areas?

Seabirds such as gulls

FIG. 5C

BOARD GAMES AND METHODS OF PLAYING

CROSS-REFERENCE TO RELATED APPLICATIONS

This application is a continuation-in-part of U.S. patent application Ser. No. 12/888,953 filed Sep. 23, 2010, which claims benefit to the Provisional Application Ser. No. 61/244,904 filed Sep. 23, 2009, which is incorporated by reference herein in its entirety.

TECHNICAL FIELD

The present invention generally relates to board games.

BACKGROUND

As background, people often play board games for enjoyment. Some board games ask questions related to general trivia. However, some players may wish to play a board game that is directed to a more specific area of knowledge. Also, because trivia board games require a level of knowledge for a player to be competitive, not all players are suited to play in one game.

Accordingly, a need exists for alternative board games.

SUMMARY

In one embodiment, a board game includes a plurality of game pieces, a plurality of reward cards, and a game board, where the game board includes a travel path on the game board, said travel path including a plurality of instruction spaces, a plurality of hidden cache spaces, and a plurality of open cache spaces, where one of said plurality of hidden cache spaces and one of said plurality of open cache spaces are associated with one of said plurality of game pieces, and at least one instruction space includes directions to add one of said plurality of reward cards to one of said plurality of open cache spaces that is associated with one of said plurality of game pieces.

In another embodiment, a method of playing a board game includes using a plurality of reward cards, a game board that comprises a travel path on the game board, said travel path comprising a plurality of instruction spaces, a first game piece, a first hidden cache space associated with said first game piece, a first open cache space associated with said first game piece, a second game piece, a second hidden cache space associated with said second game piece, and a second open cache space associated with said second game piece. The method further includes beginning a turn with first game piece at a first instruction space, advancing said first game piece along said travel path until said first game piece has moved a predetermined number of spaces and lands on a second instruction space, said second instruction space including directions to interact with one of said plurality of game cards, interacting with one of said plurality of game cards, where at least one of said plurality of game cards includes directions to remove one of said plurality of reward cards from said second open cache space, and ending said turn.

In yet another embodiment, a board game related to birds includes a plurality of game pieces including bird indicia, a plurality of reward cards including food indicia, and a game board. The game board includes a travel path on the game board, the travel path including a plurality of instruction spaces and at least one start space, a plurality of hidden cache spaces, and a plurality of open cache spaces, where one of said plurality of hidden cache spaces and one of said plurality of open cache spaces are associated with one of said plurality of game pieces, and where the instruction spaces include directions that relate to a behavior of birds.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative in nature and not intended to limit the subject matter defined by the claims. The following detailed description of the illustrative embodiments can be understood when read in conjunction with the following drawings, where like structure is indicated with like reference numerals and in which:

FIGS. 4A-C depict instruction cards according to one or more embodiments shown and described herein;

FIGS. 5A-C depict question cards according to one or more embodiments shown and described herein;

DETAILED DESCRIPTION

The embodiments described herein generally relate to a board game. The board game includes a game board that includes a plurality of hidden cache spaces and open cache spaces. During the course of play of the game, a first player may be directed to place a reward card in one of the hidden cache spaces or the open cache spaces that is associated with the first player's game piece. A second player may be able to remove a reward card from the open cache space associated with the first player's game piece, but may be prevented from removing a reward card from the hidden cache space associated with the first player's game piece. This feature of the game replicates a behavior of some birds who hide food for their own consumption, protecting the food from other birds.

In another embodiment, the board game includes a plurality of game cards, the game cards including a plurality of instruction cards and a plurality of question cards. The instruction cards may provide simple directions to the players and may be associated with a low level of trivia knowledge. The question cards may require the players to correctly answer a question to progress towards finishing the game. The question cards may be associated with a high level of trivia knowledge. The instruction cards and the question cards may be used simultaneously to allow players having a low level of trivia knowledge to compete with players having a high level of trivia knowledge.

In yet another embodiment of the board game, the board game is related to birds and may be related to a specific type or species of bird, including, but not limited to, ravens, sparrows, crows, or eagles. The board game may be directed to birds as a Kingdom, Phylum, Family, Order, Genus, or Species. For illustration, and not limitation, the board game will be shown and described herein with reference to a game directed to a species of bird called ravens; however, a reader should understand that the board game may be produced with reference to a number of birds. In such an example, the board game may be called "The Conspiracy of Ravens," although other titles may be used as well. A "conspiracy" is a collective noun used to describe a group of ravens. Similar titles may be used for other types of birds. Features of the board game may replicate behaviors and characteristics of the birds. For example, some birds hide food for their own consumption, protecting the food from other birds. This behavior is replicated in the hidden cache space, which allows a player to shield reward cards from competitors.

Figure 1:
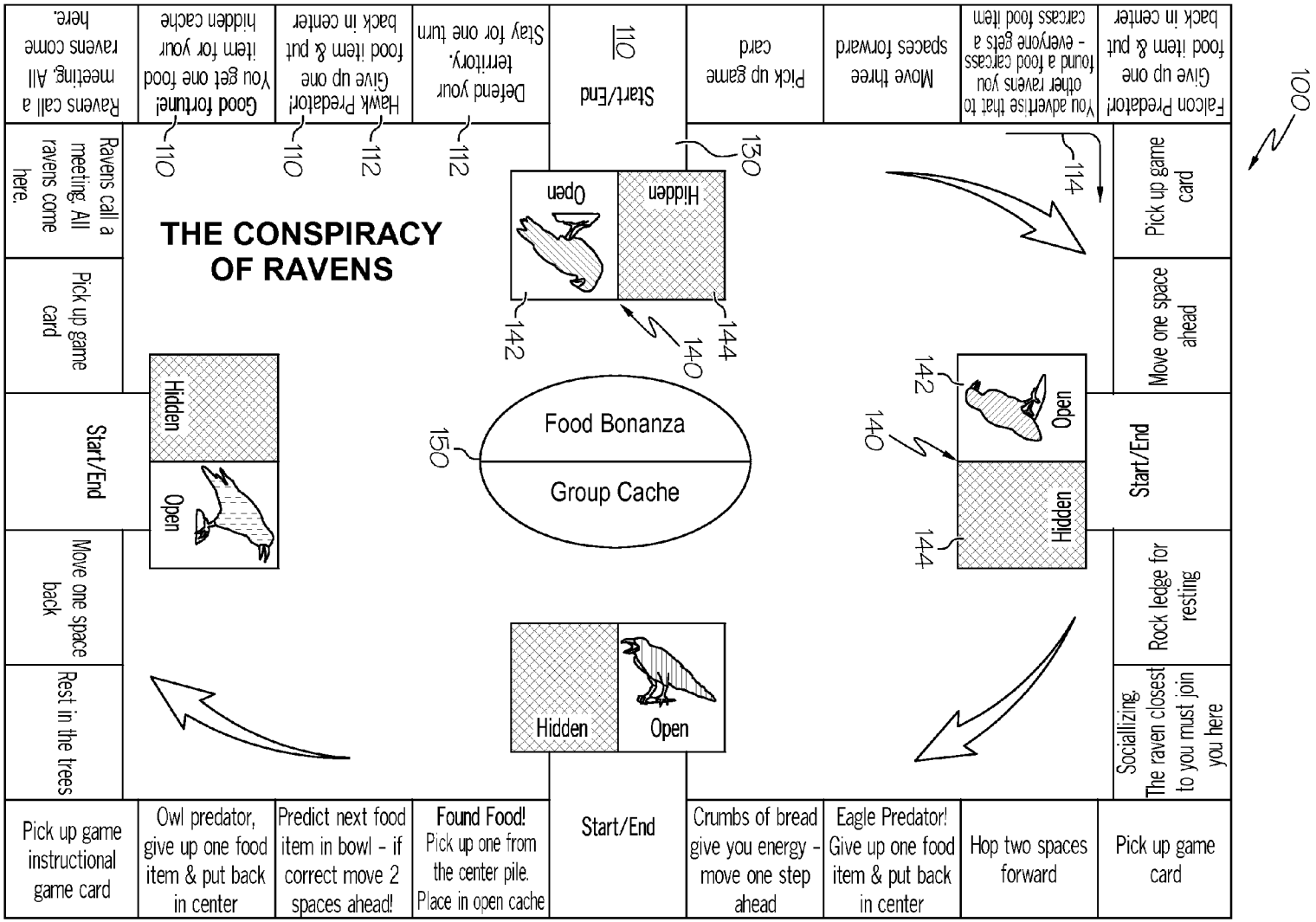
FIG. 1 depicts the game board according to one or more embodiments shown and described herein.

As illustrated in FIG. 1, the board game may be operable for two to four players, although not limited to such numbers. The board game may facilitate the learning about birds in general and, particularly, about a specific species of bird, for example, ravens. The board game permits the players to learn about the types of food that particular species eats (e.g., what a raven eats), as well as what are predators of that species (e.g., what are predators of the raven). The players also learn about the social habits of a specific bird (e.g., the raven). The object of the game is to collect as many cards representing food as possible. At the end of the game, the player with the most "food" wins the game.

Figure 2A:
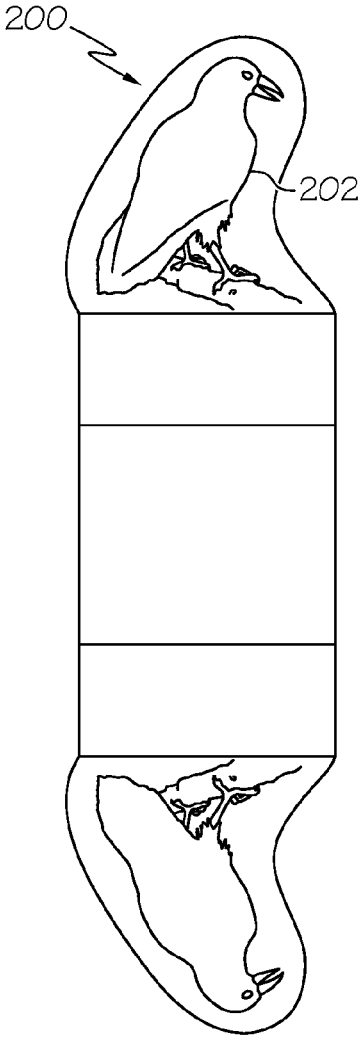
FIGS. 2A-B depict game pieces according to one or more embodiments shown and described herein.
Figure 2B:
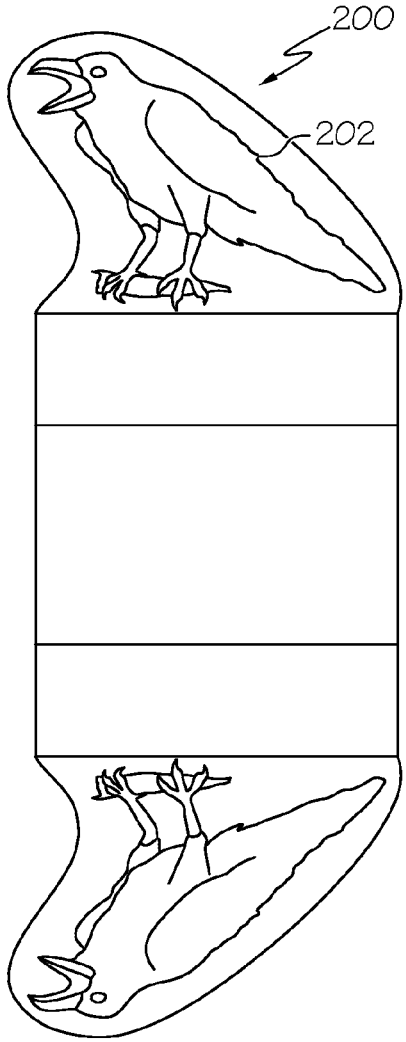

As shown in FIG. 1, the game board 100 may have a rectangle shape and have a series of spaces 110 around the perimeter. These spaces 110 may be instruction spaces 112 that include directions that a player whose game piece 200 lands on the instruction space 112 should follow. Other suitable geometries may be used for the game board 100 as well. In the embodiment illustrated in FIG. 1, two to four players, or two to four teams of players, may participate in the game, where each of the players has his or her own game piece 200, examples of which are shown in FIGS. 2A-B. It is understood that the board game may be designed to permit any number of players to participate.

Figure 3A:
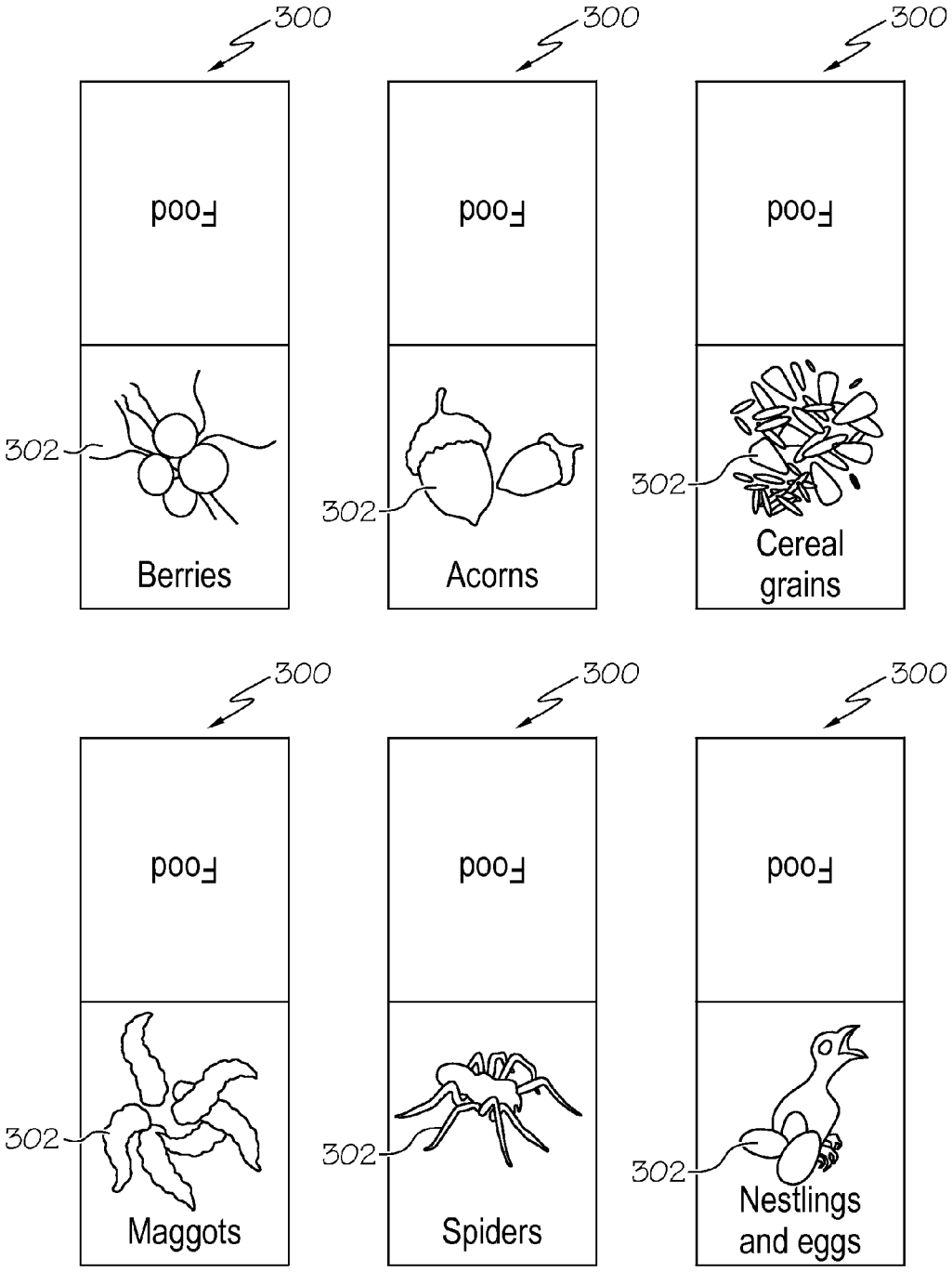
FIGS. 3A-C depict reward pieces and pitfall pieces according to one or more embodiments shown and described herein.
Figure 3B:
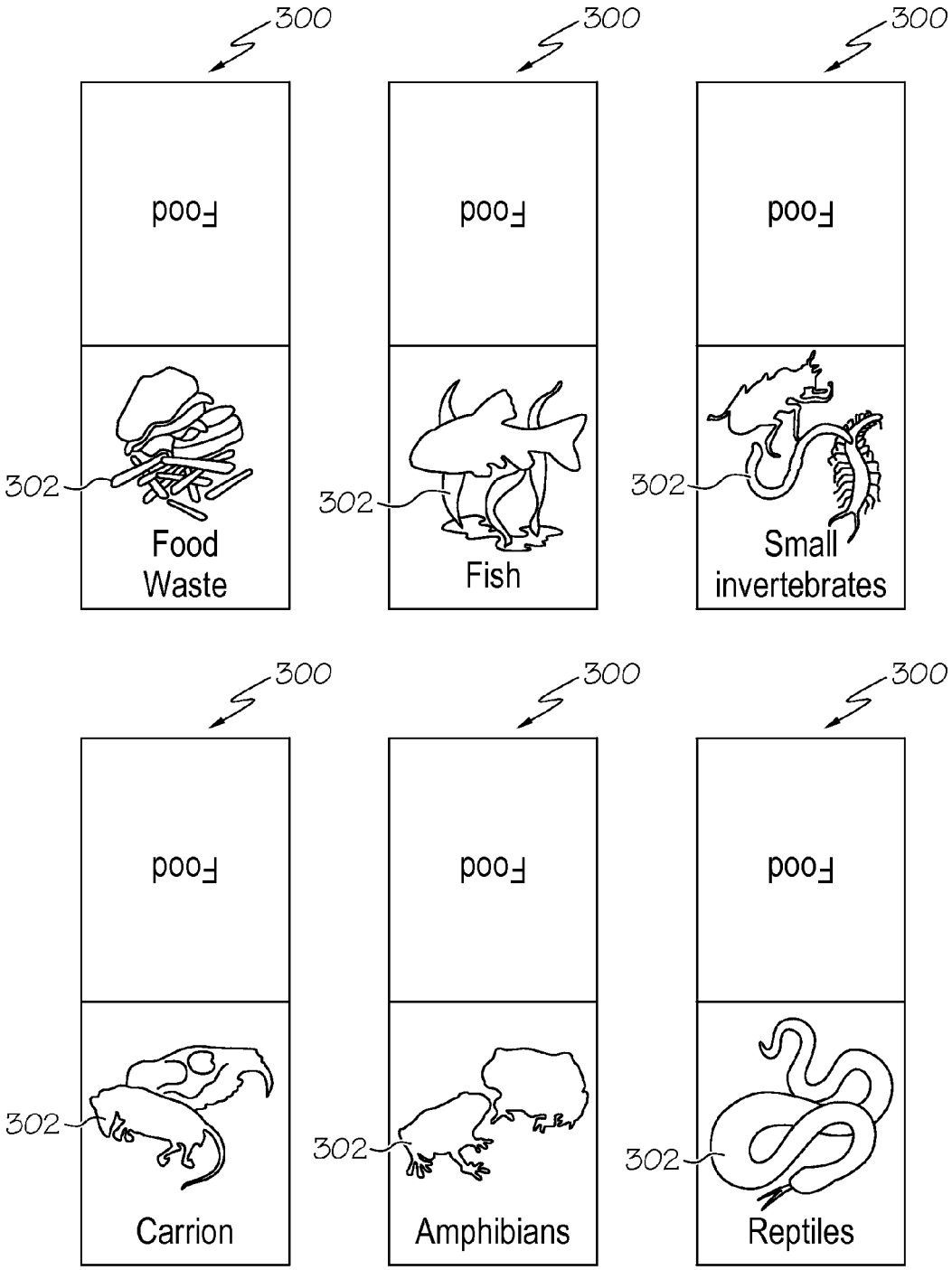
Figure 3C:
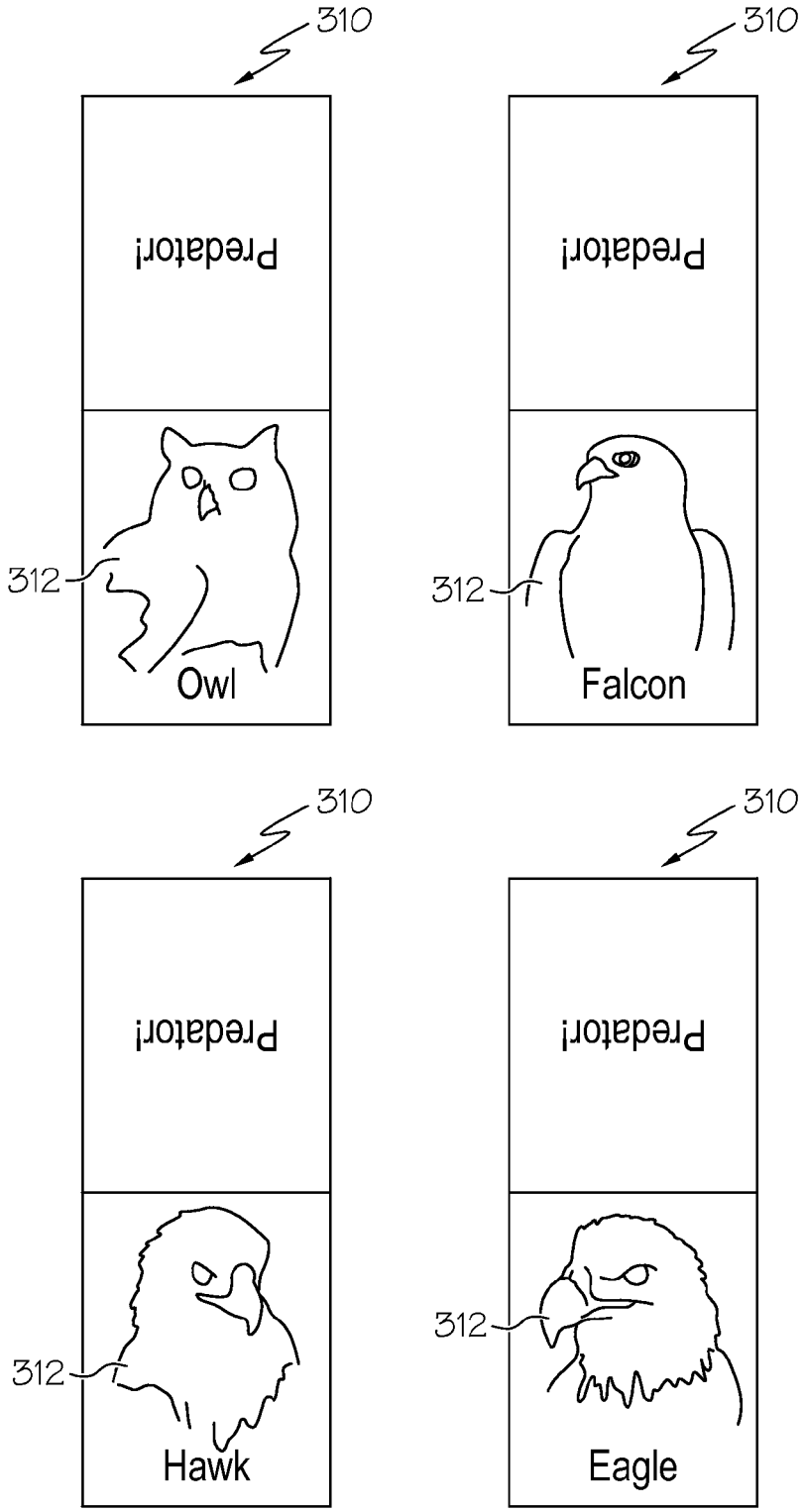

The goal of the game is for each player to collect as many reward cards 300, which are illustrated in FIGS. 3A-C, as possible. Each of the four sides of the game board 100 may have a "Start/End Space," 130 one for each of the four players. Furthermore, each of the four sides may have a cache location 140 to store reward cards 300 that are collected throughout game play, each of which may be divided into an "Open" section, labeled as an open cache space 142 and "Hidden" section, labeled as a hidden cache space 144. Each of the open cache spaces 142 and the closed cache spaces 144 may be associated with one of the game pieces 200 that are used by each of the players. The open cache space 142 and the closed cache space 144 may be associated with a game piece 200 and one another. For example, one open cache space 142, one closed cache space 144 and one game piece 200 may be associated with each other or grouped together using a common color on each of the open cache space 142, the closed cache space 144, and the game piece 200. As another example, FIG. 1 shows the game board comprising four groupings of associated open cache space, closed cache space and game piece. As such, each of the groupings or associations may comprise a distinct color or indicia to identify each grouping of associated open cache space, closed cache space, and game piece.

The open cache space 142 is used to store reward cards 300 that may often be taken later by other players. Additionally, each start/end space 130 may have the same common color to associate one of the start/end spaces 130 with a player's game piece 200. In one embodiment, an open cache space 142 may contain reward cards 300 including food indicia 302 (i.e., food cards) that may easily be taken by other players (i.e., the reward cards 300 represent food that may be "eaten" by other ravens). The hidden cache space 144 is used to store reward cards 300 that may be restricted from being taken by other players. In one embodiment, a hidden cache space 144 may contain reward cards 300 including food indicia 302 that other players cannot easily access (i.e., the reward cards 300 represent food that is "hidden" and protected from other ravens). As discussed above, the hidden cache space 144 replicates a behavior of ravens, who are known to hide food from other ravens for later consumption.

The game board 100 may also have a group cache location 150 to store the reward cards 300 that has not yet been collected by any player. The group cache location 150 may be in the middle of the game board 100 and may be called "Food Bonanza Group Cache," in reference to food that any of the "ravens" are entitled to. The reward cards 300 including food indicia 302 (e.g., the reward cards 300 shown in FIGS. 3A-C) may be placed in this location. A bowl or other container may be used to keep the reward cards 300 together. The game board 100 may further have a designated location to store game cards 400, subsets of which are instruction cards 402 and question cards 500 which are illustrated in FIGS. 4A-C and FIGS. 5A-C, respectively, and discussed in more detail below. Each group of game cards 400 may be stored on either side of the reward cards 300.

The spaces 110 on the game board 100 may include instruction spaces 112 printed with directions that a player whose game piece 200 lands on the instruction space 112 should follow. The spaces 110 together form a travel path 114 that the game pieces 200 move about. When a game piece 200 lands on a particular instruction space 112, the player should interact with the instruction space 112 by reading and following the directions printed in that instruction space 112. In one embodiment, one of the instruction spaces 112 may state, "Hawk Predator! Give up one food item & put back in center." Thus, if a player lands on this instruction space 112, the player should give up control of one of his or her reward cards 300 including food indicia 302 and place the reward card 300 back in the group cache location 150 labeled "Food Bonanza Group Cache." Other instruction spaces 112 may include directions to the player that the player lose a turn, pick up a game card 400, place a reward card 300 into the player's open cache space 142, place a reward card 300 into the player's hidden cache space 144, remove a reward card 300 from the player's open cache space 142, remove a reward card 300 from the player's hidden cache space 144, or remove a reward card 300 from the player's open cache space 142, and if no reward card 300 is present, remove a reward card 300 from the player's hidden cache space 144. The language of the directions on the instruction space 112 may reference particular behaviors that birds exhibit.

FIGS. 2A-B depict a series of illustrative game pieces 200. These game pieces 200 may include different types of bird indicia 202, such as, for example, bird indicia 202 representing different types of ravens, and may be printed on paper so as to allow the players to cut them out and assemble them. The game pieces 200 may be printed in black and white or may be printed in color. Alternatively, the game pieces 200 may be fabricated from any variety of materials, including but not limited to cardboard, paperboard, plastic, wood, metal, composites, or any combination thereof. In another embodiment, the game pieces 200 may be metal, plastic, wooden or other material models which may include, but are not limited to, representations of birds, bird nests, or other objects associated with birds. The game pieces 200 and bird indicia depicted in FIGS. 2A-B are illustrative in nature, and other game pieces and/or bird and/or other indicia (including indicia directed to other animals and/or items) are contemplated for use as or on the game pieces 200.

FIGS. 3A-B depict a series of illustrative reward cards 300 that include food indicia 302. Reward cards 300 that include food indicia 302 may be referred to as "food cards" in the game instructions. The reward cards 300 may include food indicia 302 depicting, for example, but not limited to, berries, acorns, cereal grains, maggots, spiders, and nestlings and eggs, food waste, fish, small invertebrates, carrion, amphibians, reptiles, and shellfish. These food indicia 302 represent food items that the bird may eat such as, for example, the food an actual raven may eat. The reward cards 300 depicted in FIGS. 3A-B are illustrative in nature, and other rewards and/or food relating to birds and/or other animals are contemplated for use on the reward cards 300.

The game may also include one or more pitfall cards 310. FIG. 3C, depicts a series of illustrative pitfall cards 310. The pitfall cards 310 may comprise predator indicia 312, illustrating predators of the bird the game is directed to such as, for example, predators of ravens. The pitfall cards 310 may include predator indicia 312 representing, for example, an owl, a falcon, a hawk, and an eagle. The pitfall cards 310 depicted in FIG. 3C are illustrative in nature, and other pitfalls and/or predators relating to birds and/or other animals are contemplated for use on the pitfall cards 310.

Each of the reward cards 300 and pitfall cards 310 may be printed on paper so as to allow the players to cut them out and fold them over onto themselves. In this fashion, the reward cards 300 and the pitfall cards 310 may be positioned such that the side of the card containing the indicia 302, 312 is not visible. A descriptor term may be printed on the side opposite to the indicia 302, 312. In one embodiment, one or more of the rewards cards 300 printed with food indicia 302 on one side may have "Food" printed on the opposite side. Additionally, one or more of the Pitfall cards 310 printed with predator indicia 312 on one side may have "Predator!" printed on the opposite side. The reward cards 300 and the pitfall cards 310 may be placed "face down" so that only "Food" or "Predator!" is visible to the players. Thus, the reward cards and pitfall cards 300, 310 may have a pictorial indicia (e.g., food indicia 302, predator indicia 312) on one side and a descriptor word (e.g., "Food", "Predator") on the opposite side, respectively. Similar to the game pieces 200, the reward cards 300 and the pitfall cards 310 may be printed in black and white or may be printed in color. These reward cards 300 and the pitfall cards 310 may be fabricated from any variety of materials, including but not limited to cardboard, paperboard, plastic, wood, metal, composites, or any combination thereof. In another embodiment, these items may be metal, plastic, wood, or other material models which represent the actual reward or pitfall, including, but not limited to, berries, acorns, owls, and eagles and the like.

Figure 4C:
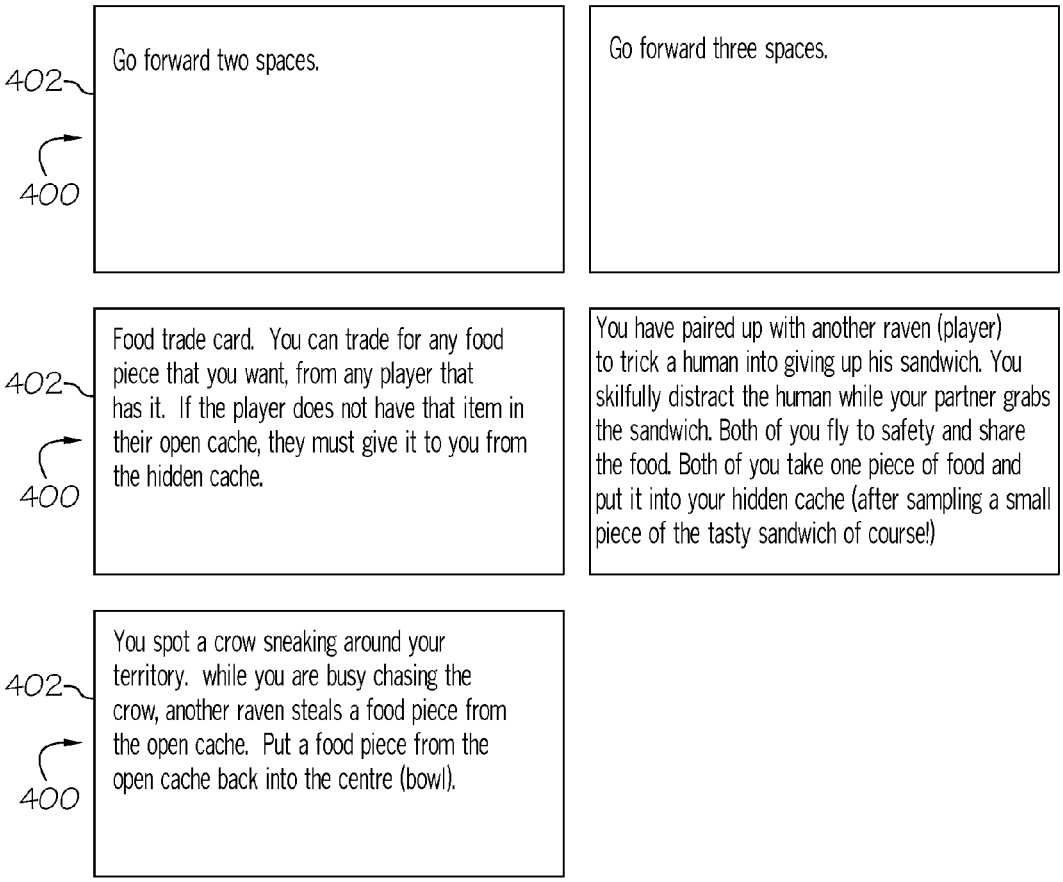

FIGS. 4A-C depicts a series of illustrative instruction cards 402 which are a subset of game cards 400. Players may be required to pick up one of these instruction cards 402 if they land on an instruction space 112 on the game board 100 that states "Pick up game card." The instruction cards 402 may direct the player to take a particular action. In one embodiment, the instruction card 402 may direct the player as follows: "You are a playful raven. Lying on your back you miss the opportunity to take food to the hidden cache. You must wait one turn before you jump back on your feet!" Such directions may teach players about the behaviors of the raven. Another instruction card 402 may direct the player to "Go forward one space." The instruction cards 402 depicted in FIGS. 4A-C are illustrative in nature, and other directions for the instruction cards 402 are contemplated.

FIGS. 5A-C depicts a series of illustrative question cards 500 which are a subset of game cards 400. The question cards 500 are printed with questions related to ravens and correct answers to the questions. Players may be required to pick up one of these question cards 500 if they land on an instruction space 112 on the game board 100 that states "Pick up game card." The question cards 500 may be read by one player to another as to ask the question while maintaining the secrecy of the correct answer. If the player answers the question correctly, the game piece 200 that the player is using may remain on that instruction space 112. If the player answers incorrectly, the player may be required to return the game piece 200 to its previous space 110 along the travel path 114. In one embodiment, a question card 500 may ask of the player, "The Common Raven is also known as what?" In another embodiment, a question card 500 may ask of the player, "What family is the Raven found in?" The question cards 500 depicted in FIGS. 5A-C are illustrative in nature, and other questions relating to birds and/or other animals are contemplated for use on the question cards 500.

The players may decide before starting the game whether to use instruction cards 402 or question cards 500 when landing on a "Pick up game card" space 110. If the players are young or inexperienced, they may elect to use the instruction cards 402, which have relatively simple directions (i.e., low level). However, if the players are older or more knowledgeable about the relevant subject matter (e.g., ravens) they may elect to use the question cards 500, which may ask relatively complex questions (i.e., high level). Alternatively, if the players' knowledge of the relevant subject matter is mixed, the players may decide that some players pick up instruction cards 402 and other players pick up question cards 500 in the same game.

Figure 6:
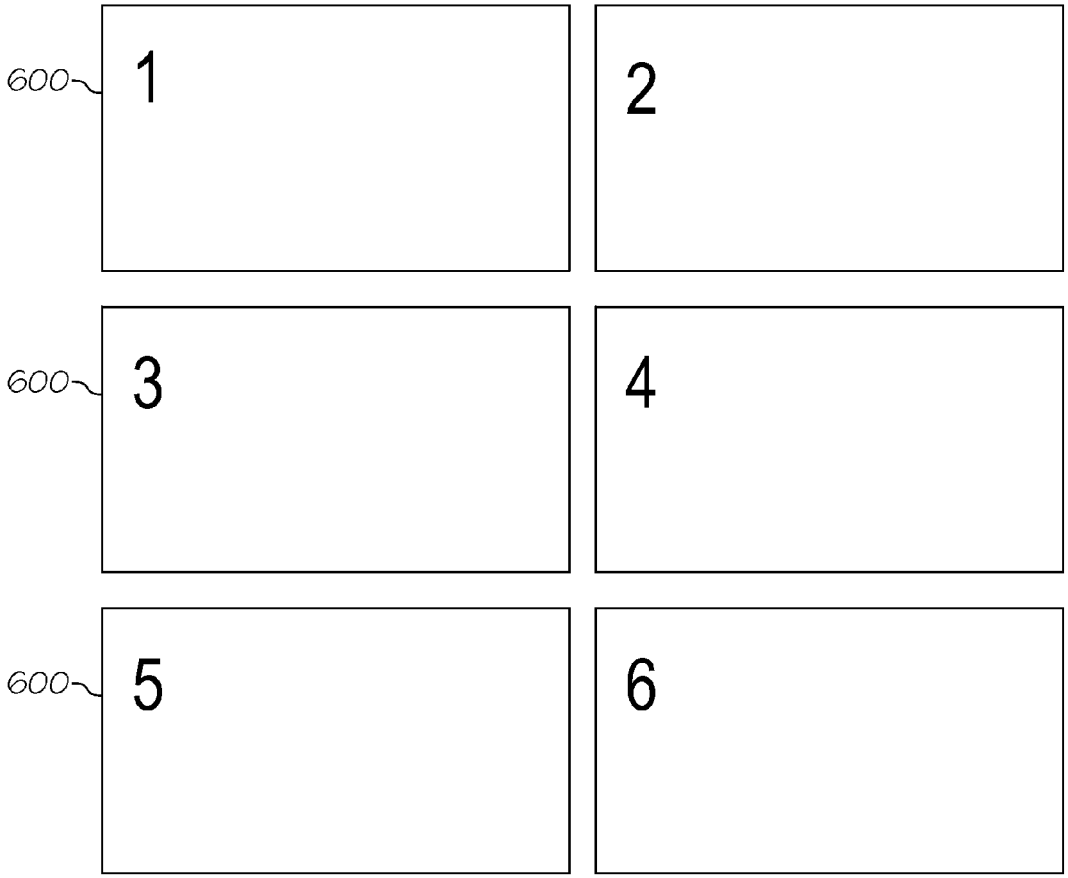
FIG. 6 depicts number pieces according to one or more embodiments shown and described herein.

As described herein, the players may advance their game pieces 200 along the travel path 114 by picking number pieces 600 at random from a bowl. Alternatively, the players may advance their game pieces 200 by rolling a die or spinning or activating a number indicator as conventionally known in the game arts. FIG. 6 depicts number pieces 600 for the board game. These may be cut out and used instead of a die. A player may, when taking his turn, select one number piece 600 from a bowl containing all six number pieces 600. The bowl may be positioned so that the player cannot see the numbers on the number pieces 600. The number on the selected number piece 600 is the number of spaces 110 the player is permitted to advance his or her game piece 200 along the travel path 114. As one alternative, the players may roll a die (or dice) to determine the number of spaces 110 the player is permitted to advance his or her game piece 200 along the travel path 114. Other conventional methods of determining how many spaces 110 to advance a game piece 200 along the travel path 114 may be used as well.

The game board 100 and various game components depicted in FIGS. 1-6 may be manufactured and placed in a box which may be sold in stores or over the Internet. The outside of the box may have colorful drawings and/or text to attract and inform customers. Alternatively, the game may be purchased and downloaded from the internet (or from a computer server) because it is possible to print the game board 100 and game components on a standard computer printer. Once the images are downloaded and printed, the game board 100 and game components may be assembled as previously described herein. For example, a customer may purchase the game over the internet and pay for it via credit card, electronic transfer, or other similar payment method. Upon payment, the customer may be permitted to download documents and/or images (for example, in JPEG, bitmap, PDF, or other commonly readable formats) of the game board 100 and game components and then print such documents and/or images. As an alternative, the customer may be permitted only to print the game board 100 and game components directly from the Internet. It is contemplated that other methods to sell and distribute the board game may be used as well.

The board game described herein may be suitable for ages seven and up. The game board 100 depicted in FIG. 1 may allow two, three, or four players to play this game at the same time, or two, three, or four teams of players. To set up the game board 100, the players may print off the electronic pages that include the spaces 110 and place a heavy and flat object underneath these pages to construct the game board 100. The players may want to adhere these pages onto a backing material, for example cardboard, heavy paper, wood, plastic, metal, or a plurality of pages of thin paper reinforced with one another, to add stability and rigidity to the game board 100.

When initially setting up the board game, the players may be required to print off all the game pieces 200 and cut them out. To add strength to the game pieces 200, the players may consider gluing the paper cut-outs to a piece of cardboard, paperboard, plastic, or heavy paper. Before starting a game, the players may be required to cut out all the reward cards 300, mix them up, and put them in the middle of the game board 100, possibly in a bowl or other container. The players may print off the electronic pages containing reward cards 300 multiple times so that the players have a sufficient number of reward cards 300. The players may also cut out the game pieces 200, cutting along solid black line, and folding carefully along the dashed lines. The players may use glue or tape to join surfaces of the game pieces 200 together, such that the game pieces 200 stand upright.

In order to set up the pitfall cards 310, the players may cut out the predator indicia 312 on the pitfall cards 310, for example, the eagle, owl, hawk and falcon. The player may assemble and place these pitfall cards 310 or the cut out predator indicia 312 outside of the game board 100.

As previously discussed herein, there are two types of game cards 400, the instruction cards 402 and the question cards 500. The players may cut out the game cards 400 and put them into two stacks: one for the instruction cards 402 and one for the question cards 500. As previously discussed, the players may decide at what level to play the game. The instruction cards 402 may provide directions to a player to perform a simple action. The question cards 500 may be used by the more adventurous and skilful players and may be used to increase the players' knowledge about ravens. The instruction cards 402 may be used for the beginner player at any age, or a player who wants to play the board game without requiring a great deal of mental exercise.

When initially setting up the game, the players may also download, print, and cut out the number pieces 600, fold them once, and put them into a bowl or set aside in an arrangement outside of the game board 100. A six-sided die may be used as an alternative.

The objective of the board game is to collect the most reward cards 300 in the hidden cache space 144 while minimizing the reward cards 300 in the open cache space 142. This objective replicates the behaviors of some birds, in particular ravens. Ravens are sociable animals and work together to find food. However, an individual raven may go to great lengths to store the excess amount of food that it cannot eat right away. Food that is stored by one raven can easily be found by another if the hiding place has been discovered, while food that is successfully hid from the other ravens can be eaten later by the raven who captured the food. This behavior is replicated by the two types of cache spaces, the open cache space 142 and the hidden cache space 144. A reward card 300 stored in the open cache space 142 may be more susceptible to theft by other players, while a reward card 300 stored in the hidden cache space 144 represents what the player has successfully kept for himself or herself. In one embodiment, the number of game cards 400 and instruction spaces 112 that direct a player to relinquish control of a reward card 300 currently held in that player's hidden cache space 144 may be less than the number of game cards 400 and instruction spaces 112 that direct a player to relinquish control of a reward card currently held in that player's open cache space 142. Because these game cards 400 are drawn at random, there is a smaller likelihood that any player will have to relinquish control of a reward card 300 held in that player's hidden cache space 144 than a reward card held in that player's open cache space 142. As such, reward cards 300 held in the hidden cache space are generally protected. At the end of the game, the player with the most reward cards 300 in the hidden cache 144 wins the game.

The rules of the board game are as follows:

1. Each player chooses a raven game piece. Place the raven game piece in the respective colored territory on the game board. Each territory is divided into 2 sections: open cache and hidden cache. When you accumulate food pieces you will be instructed as to which area (i.e., open cache or hidden cache) of the territory you are to pile the food pieces.
2. Put the bowl with all the food pieces in the center of the game board.
3. Place the two decks of game cards (e.g., instruction and question) on each side of the food cache in the center.
4. Each player takes a number from the number bowl. The player with the highest number starts the game. If you have a die, throw it one time for each player. Again, the highest number starts the game. Put the numbers back in the bowl and mix them up.
5. Each player starts out with two food pieces for each cache.
6. The first player takes a number from the bowl. The number drawn is the number of spaces the player moves on the game board. Depending on where the raven game piece lands, the player must do what is instructed on the game board. If two players land on the same square, both players must draw a number card. The player with the highest number gets to move one space forward on the game board.
7. The player who ends up back at his/her territory must "cache out" from the open and hidden storage areas. The number of food cards in the open cache must be deducted from the number of food cards in the hidden cache.
8. The winner of the game is not decided until all the players have been once around the board and are back at their territory. The player with the highest number of food pieces wins the game.
9. To mix up the game, randomize the instruction cards and question cards.

Figure 7:
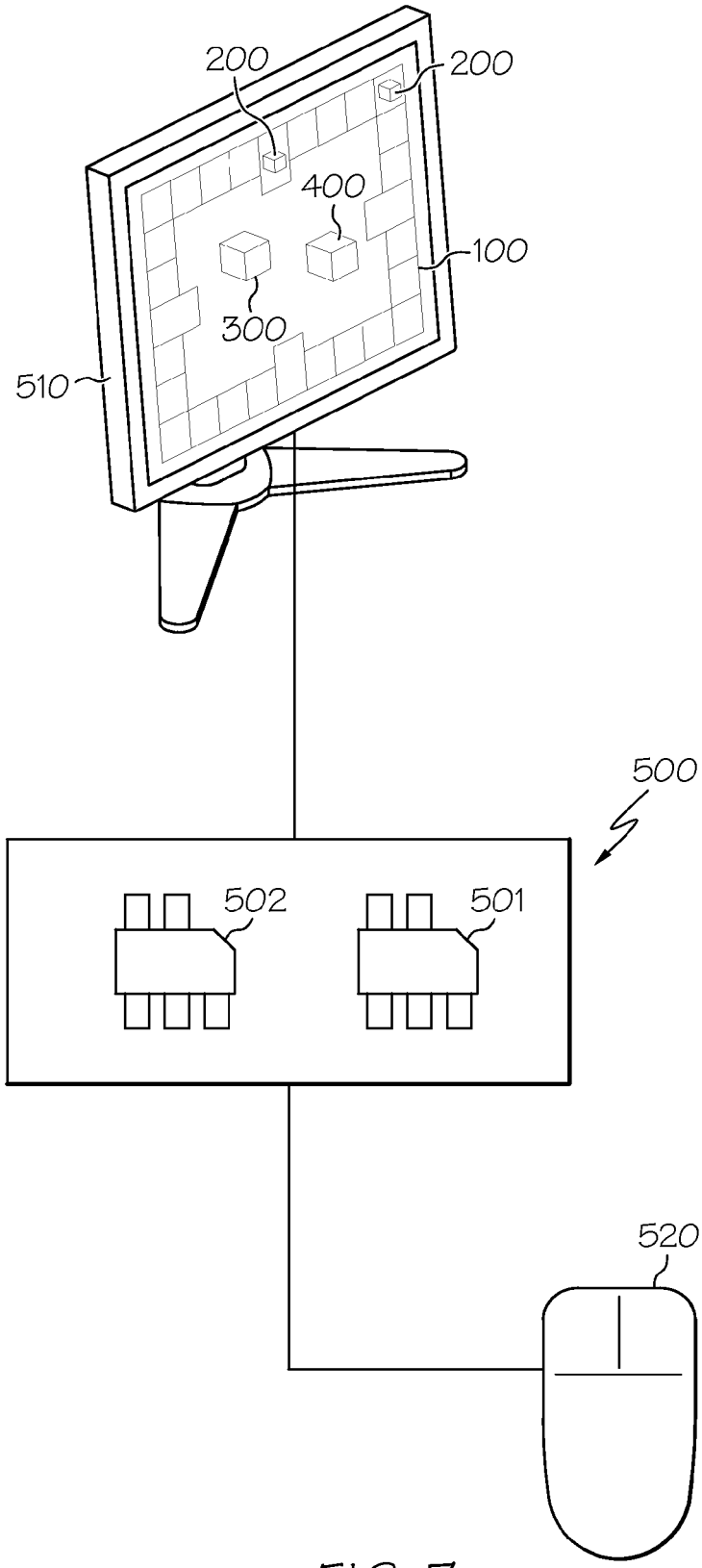
FIG. 7 depicts a computing device executing a computer-readable instruction set to display the game board according to one or more embodiments shown and described herein.

Referring now to FIG. 7, the board game described hereinabove may be implemented by a gaming system 600 that includes a computing device 500. The computing device 500 includes a processor 502 and a memory 504 storing a computer readable instruction set. The computing device 500 is communicatively coupled to a display 510 and a user input device 520. In some embodiments of the computing device 500, the memory 504 may be a non-transient memory, for example and without limitation, a hard drive, a floppy disk, a compact disk, a digital video disk, flash memory, a gaming cartridge, and the like, that stores a computer readable instruction set. The computer-readable instruction set may be stored in internal or external media relative to the computing device 500. When the processor 502 executes the computer-readable instruction set, the computing device 500 creates the features of the board game described hereinabove. In particular, execution of the computer-readable instruction set causes the computing device 500 to display the game board 100, the game pieces 200, the reward cards 300, and the game cards 400 on the display 510. A user of the computing device 500 may interact with the board game through the user input device 520.

Figure 8:
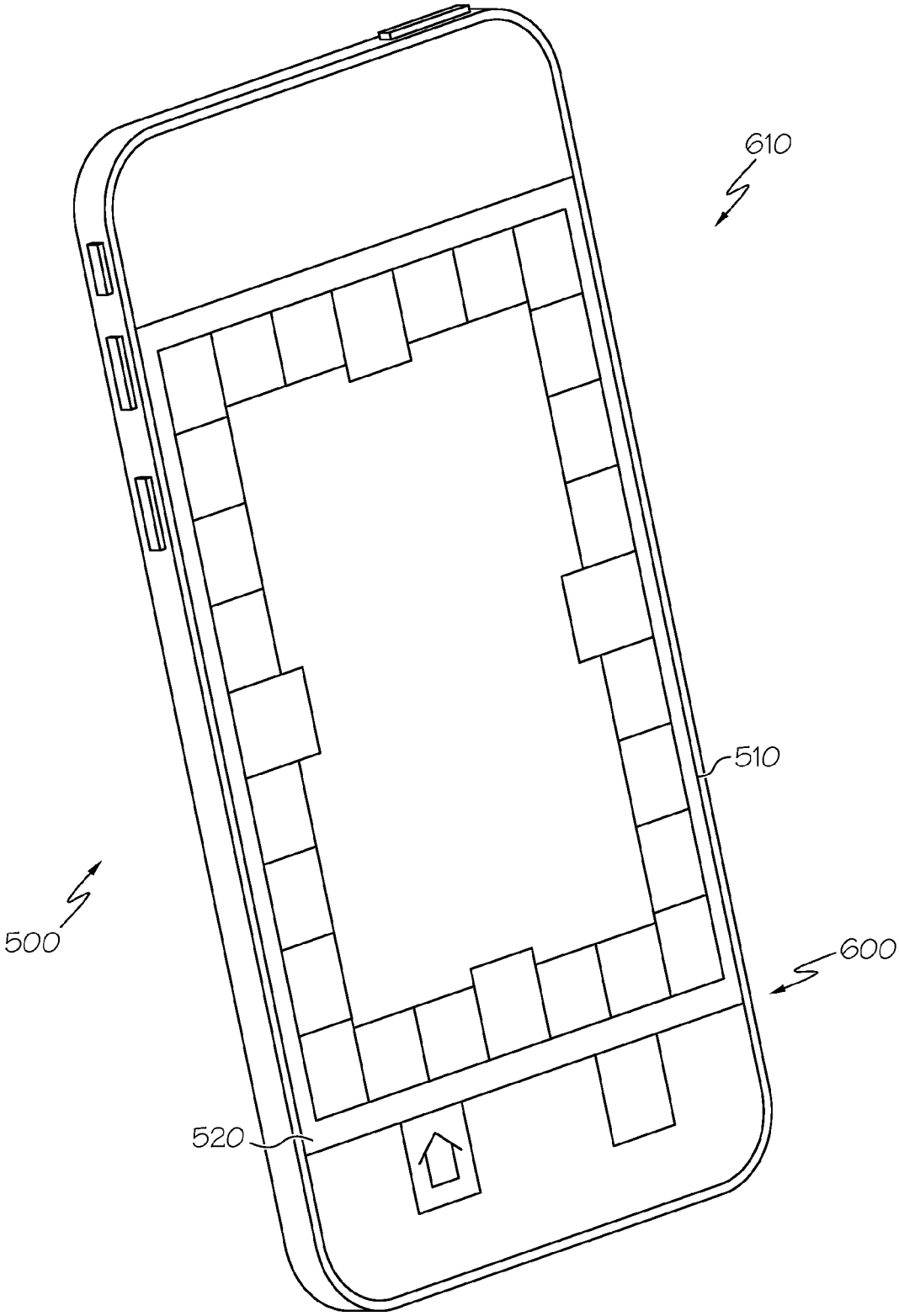
FIG. 8 depicts a handheld computing device executing a computer-readable instruction set to display the game board according to one or more embodiments shown and described herein.

Referring now to FIG. 8, in some embodiments, components of the gaming system 600 including, for example, the computing device 500, the display 510, and the user input device 520, may be incorporated into a personal computing device 610. In some embodiments, the personal computing device 610 may be a hand-held portable device, a smartphone, a tablet computer, or the like.

It should now be understood that the board game described herein generally relates to birds and, more specifically, to ravens. The board game may permit the players to learn about the types of food that ravens eat, as well as predators of the raven. The players also learn about the social habits of ravens. The game provides two sets of game cards corresponding to a lower and a higher level of knowledge of ravens. The object of the game is to collect as much food as possible. At the end of the game, the player with the most food wins the game. It should also be understood that although the above illustrative embodiments were directed to birds, and more specifically ravens, the apparatus and methods of playing board games shown and described herein may also be directed to other birds, animals, reptiles, fish, plants, etc.

All documents cited in the Detailed Description are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A non-transitory computer readable medium having instructions for causing a computing device having a processor, a memory, and a display to execute a method comprising:

displaying a game board on the display, the game board comprising a travel path on the game board, said travel path comprising a plurality of instruction spaces and a plurality of start/end spaces that are each associated with one of the plurality of players, the game board further comprising a plurality of hidden cache spaces and a plurality of open cache spaces, wherein each of said plurality of hidden cache spaces and each of said plurality of open cache spaces are each associated with one of the plurality of players;

displaying a plurality of game pieces capable of being shifted along the travel path, each of the plurality of game pieces representing one of the plurality of players;

displaying a plurality of reward cards;

displaying the plurality of game pieces in the start/end space that is associated with one of the plurality of players;

prompting a user to follow a set of instructions for taking a turn by each of the plurality of players, the turn comprising:

a current player beginning a turn with one of said plurality of game pieces at a first space;

the current player advancing said game pieces along said travel path until said game piece has moved a predetermined number of spaces and lands on a second space;

the current player interacting with the board game based on the instructions provided by the second space; and the current player ending said turn;

wherein each of the plurality of players sequentially repeat turns until each of the game pieces are advanced around the travel path and are returned to the start/end space associated with the player; and determining the winner by deducting a number of reward cards stored in the open cache space that is associated with the player from a number of reward cards stored in the closed cache space that is associated with the player, wherein during at least one turn, the current player is instructed to remove one of said reward cards stored in the open cache space that is associated with one of said players, and if no reward card is present, to remove one of said reward cards stored in the closed cache space that is associated with said player.

2. The non-transitory computer readable medium having instructions for causing a computer to execute the method of playing the game of claim 1 further comprising instructing one or more of the plurality of players removing one of said plurality of reward cards from said open cache space associated with another of said plurality of players if one of said plurality of reward cards is present in said open cache space.

3. The non-transitory computer readable medium having instructions for causing a computer to execute the method of playing the game of claim 1 further comprising removing one of said plurality of reward cards from one of said plurality of open cache spaces other than one of said plurality of open cache spaces that is associated with said game card, and, if no reward card is present in said open cache space, removing one of said plurality of reward cards from one of said plurality of closed cache spaces that is associated with said open cache space.

4. The non-transitory computer readable medium having instructions for causing a computer to execute the method of playing the game of claim 1, wherein during at least one turn, the current player places one of said reward cards in the closed cache space associated with the current player based on the interaction of the current player with the board game.

5. The non-transitory computer readable medium having instructions for causing a computer to execute the method of playing the game of claim 4, wherein during at least one turn, the current player places one of said reward cards in the closed cache space associated with the current player based on the interaction of the current player with the board game.

6. The non-transitory computer readable medium having instructions for causing a computer to execute the method of playing the game of claim 5, wherein during at least one turn, the current player removes one of said reward cards from the open cache space associated with the current player based on the interaction of the current player with the board game.

7. The non-transitory computer readable medium having instructions for causing a computer to execute the method of playing the game of claim 6, wherein during at least one turn, the current player removes one of said reward cards from the closed cache space associated with the current player based on the interaction of the current player with the board game.

8. The non-transitory computer readable medium having instructions for causing a computer to execute the method of playing the game of claim 1, further comprising providing a plurality of instruction cards, wherein during at least one turn, the current player interacts with one of said plurality of instruction cards as instructed by the second space.

9. The non-transitory computer readable medium having instructions for causing a computer to execute the method of playing the game of claim 8, wherein:

at least one of said plurality of instruction cards comprise directions to remove one of said plurality of reward cards from one of said plurality of open cache spaces that is associated with the current player; and during at least one turn, the current player removes one of said plurality of reward cards from said open cache space that is associated with the current player based on the interaction of the current player with said instruction card.

10. The non-transitory computer readable medium having instructions for causing a computer to execute the method of playing the game of claim 9, wherein:

at least one of said plurality of instruction cards comprise directions to remove one of said plurality of reward cards from one of said plurality of hidden cache spaces that is associated with the current player; and during at least one turn, the current player removes one of said plurality of reward cards from said hidden cache space that is associated with the current player based on the interaction of the current player with said instruction card.

11. The non-transitory computer readable medium having instructions for causing a computer to execute the method of playing the game of claim 10, wherein:

at least one of said plurality of instruction cards comprise directions to remove one of said plurality of reward cards from one of said plurality of open cache space that is associated with the current player, and if no reward card is present in said open cache space, to remove one of said plurality of reward cards from one of said plurality of hidden cache spaces that is associated with the current player; and during at least one turn, the current player removes one of said plurality of reward cards from said open cache space that is associated with the current player, and if no reward card is present in said open cache space, removes one of said plurality of reward cards from said hidden cache space that is associated with the current player based on the interaction of the current player with said instruction card.

12. The non-transitory computer readable medium having instructions for causing a computer to execute the method of playing the game of claim 1 further comprising providing a plurality of question cards, wherein during at least one turn, the current player interacts with one of said plurality of question cards as instructed by the second space.

13. A gaming system comprising:

a display;

a user input device; and a computing device having a processor and a memory for storing a computer-readable instruction set, the processor communicatively coupled to the display and the user input device, wherein the computer-readable instruction set is executed by the processor to:

display a game board on the display that comprises a travel path on the game board, said travel path comprising a plurality of instruction spaces and a plurality of start/end spaces that are each associated with one of the plurality of players, the game board further comprising a plurality of hidden cache spaces and a plurality of open cache spaces, wherein each of said plurality of hidden cache spaces and each of said plurality of open cache spaces are each associated with one of the plurality of players;

display a plurality of game pieces capable of being shifted along the travel path, each of the plurality of game pieces representing one of the plurality of players;

display a plurality of reward cards;

display the plurality of game pieces in positions at the start/end space that is associated with one of the plurality of players;

following a set of instructions for taking a turn by each of the plurality of players, the turn comprising:

a current player beginning a turn with one of said plurality of game pieces at a first space;

the current player advancing said game pieces along said travel path until said game piece has moved a predetermined number of spaces and lands on a second space;

the current player interacting with the board game based on the instructions provided by the second space; and the current player ending said turn;

wherein each of the plurality of players sequentially repeat turns until each of the game pieces are advanced around the travel path and are return to the start/end space associated with the player; and determining the winner by deducting a number of reward cards stored in the open cache space that is associated with the player from a number of reward cards stored in the closed cache space that is associated with the player, wherein during at least one turn, the current player is instructed to remove one of said reward cards stored in the open cache space that is associated with one of said players, and if no reward card is present, to remove one of said reward cards stored in the closed cache space that is associated with said player.

14. The gaming system of claim 13, wherein the computer-readable instruction set is executed by the processor to instruct one or more of the plurality of players to remove one of said plurality of reward cards from said open cache space associated with another of said plurality of players if one of said plurality of reward cards is present in said open cache space.

15. The gaming system of claim 13, wherein the computer-readable instruction set is executed by the processor to instruct one or more of the plurality of players to remove one of said plurality of reward cards from one of said plurality of open cache spaces other than one of said plurality of open cache spaces that is associated with said game card, and, if no reward card is present in said open cache space, removing one of said plurality of reward cards from one of said plurality of closed cache spaces that is associated with said open cache space.

16. The gaming system of claim 13, wherein during at least one turn, the current player places one of said reward cards in the closed cache space associated with the current player based on the interaction of the current player with the board game.

17. The gaming system of claim 16, wherein during at least one turn, the current player places one of said reward cards in the closed cache space associated with the current player based on the interaction of the current player with the board game.

18. The gaming system of claim 17, wherein during at least one turn, the current player removes one of said reward cards from the open cache space associated with the current player based on the interaction of the current player with the board game.

19. The gaming system of claim 18, wherein during at least one turn, the current player removes one of said reward cards from the closed cache space associated with the current player based on the interaction of the current player with the board game.

20. The gaming system of claim 13, wherein at least one of the game board, the game pieces, the instruction cards or the reward cards comprise indicia related to birds.

* * * * *